US011261566B2

(12) United States Patent
Eberhardt et al.

(10) Patent No.: US 11,261,566 B2
(45) Date of Patent: Mar. 1, 2022

(54) CLOTHING FOR A MACHINE FOR PRODUCING A FIBROUS MATERIAL WEB

(71) Applicant: VOITH PATENT GMBH, Heidenheim (DE)

(72) Inventors: Robert Eberhardt, Ellwangen (DE); Susanne Klaschka, Cologne (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/980,449

(22) PCT Filed: Mar. 11, 2019

(86) PCT No.: PCT/EP2019/055955

§ 371 (c)(1),
(2) Date: Sep. 14, 2020

(87) PCT Pub. No.: WO2019/175076

PCT Pub. Date: Sep. 19, 2019

(65) Prior Publication Data

US 2021/0017708 A1 Jan. 21, 2021

(30) Foreign Application Priority Data

Mar. 15, 2018 (DE) ..... 102018105956

(51) Int. Cl.
*D21F 7/08* (2006.01)
*D21F 7/10* (2006.01)

(52) U.S. Cl.
CPC ..... *D21F 7/083* (2013.01); *D21F 7/10* (2013.01)

(58) Field of Classification Search
CPC ..... D21F 7/083; D21F 7/10; D21F 1/0036; D21F 1/0054
See application file for complete search history.

(56) References Cited

U.S. PATENT DOCUMENTS

| | | | | |
|---|---|---|---|---|
| 6,189,577 | B1 * | 2/2001 | Lee | D21F 1/0036 139/383 A |
| 2009/0090425 | A1 | 4/2009 | Hawes et al. | |
| 2009/0211722 | A1 * | 8/2009 | Crook | D21F 7/10 162/358.4 |
| 2017/0044718 | A1 | 2/2017 | Wich | |

FOREIGN PATENT DOCUMENTS

| | | | |
|---|---|---|---|
| EP | 0425523 | B1 | 3/1995 |
| EP | 3196357 | A1 | 7/2017 |

* cited by examiner

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A clothing, in particular a seam felt for a machine producing a fibrous material web, in particular a paper, paperboard, tissue or pulp web, includes a base structure including or formed of a two-layer laminate structure formed of one or more flat-woven fabrics. The laminate structure has MD threads forming seam loops at two end sides of the base structure, and the two layers of the laminate structure are connected to one another by the seam loops. The clothing is made endless by connecting the end sides by a seam. The seam is made by interengaging the seam loops of both end sides and introducing an insertion element. The diameter of the seam loops LD and the diameter of the associated MD threads MDYD have a ratio LD/MDYD of between 2.5 and 4, in particular between 2.7 and 3.6.

15 Claims, 4 Drawing Sheets

Figur 1a
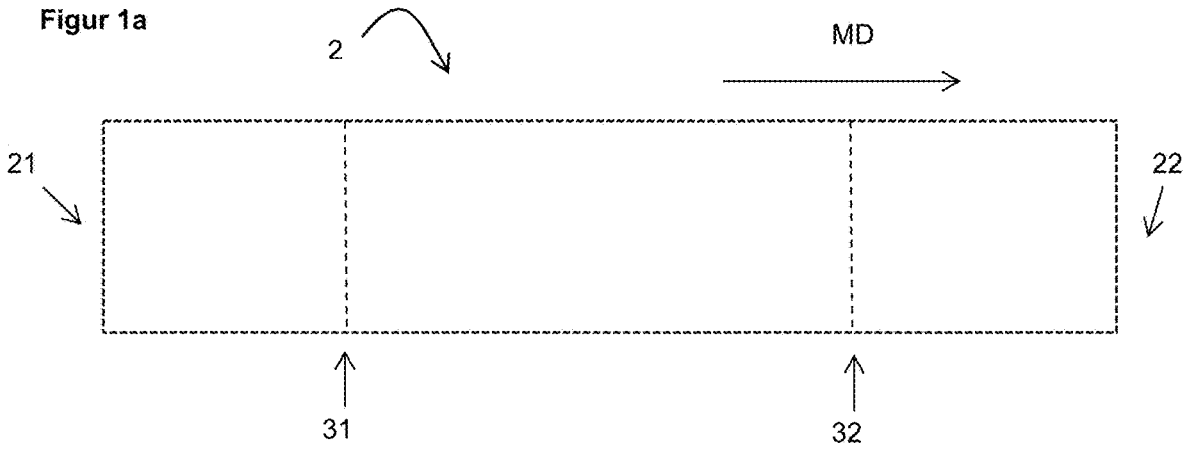
Figur 1b
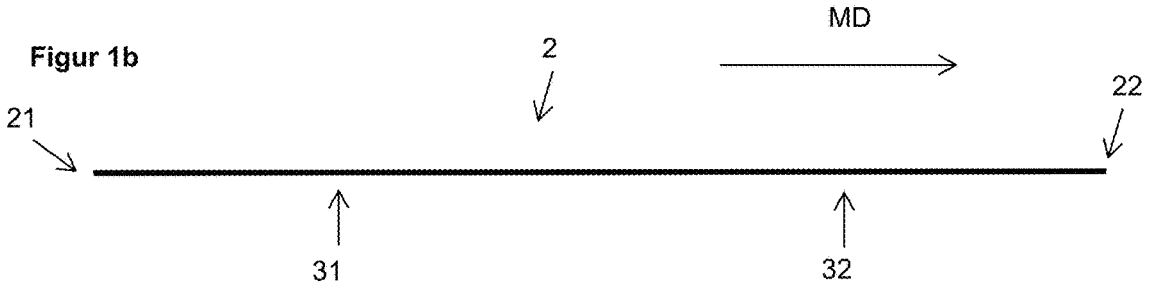
Figur 1c
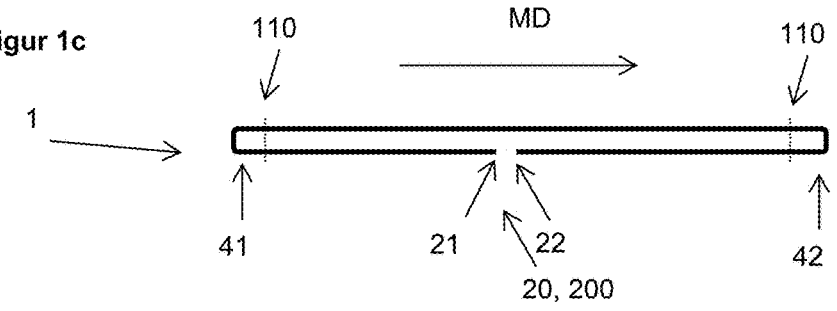

Figur 2a
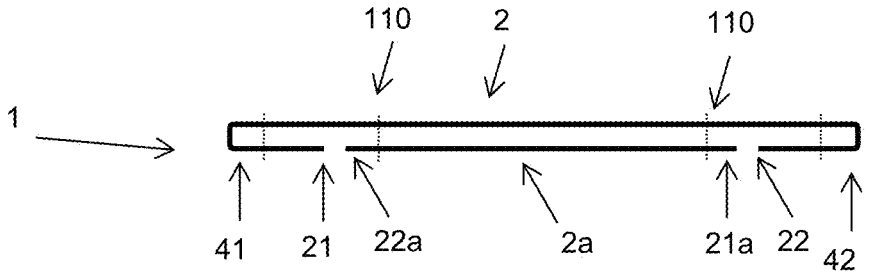
Figur 2b
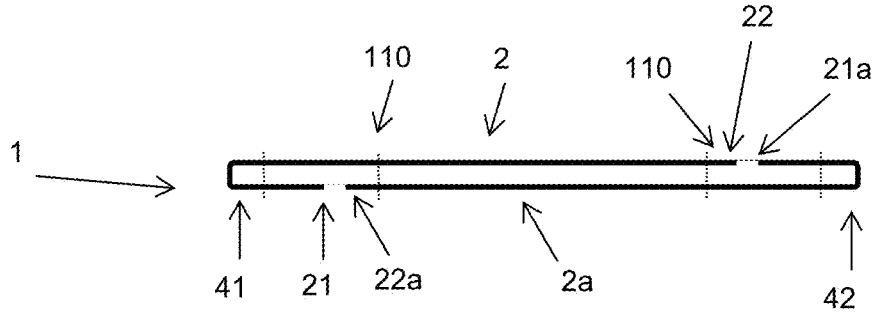
Figur 2c
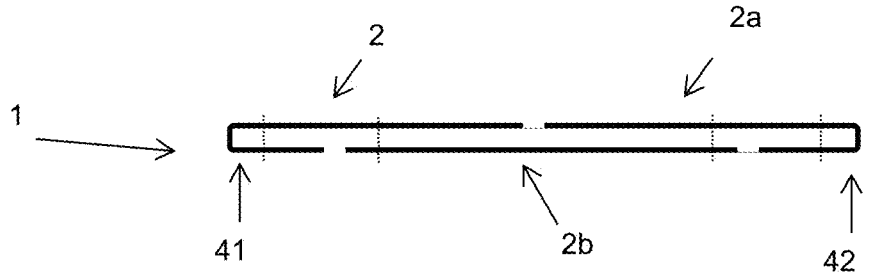

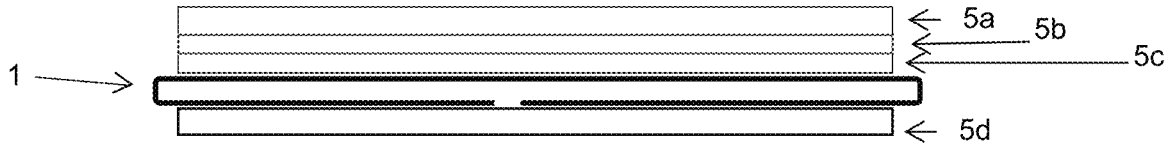
FIG. 3
FIG. 4
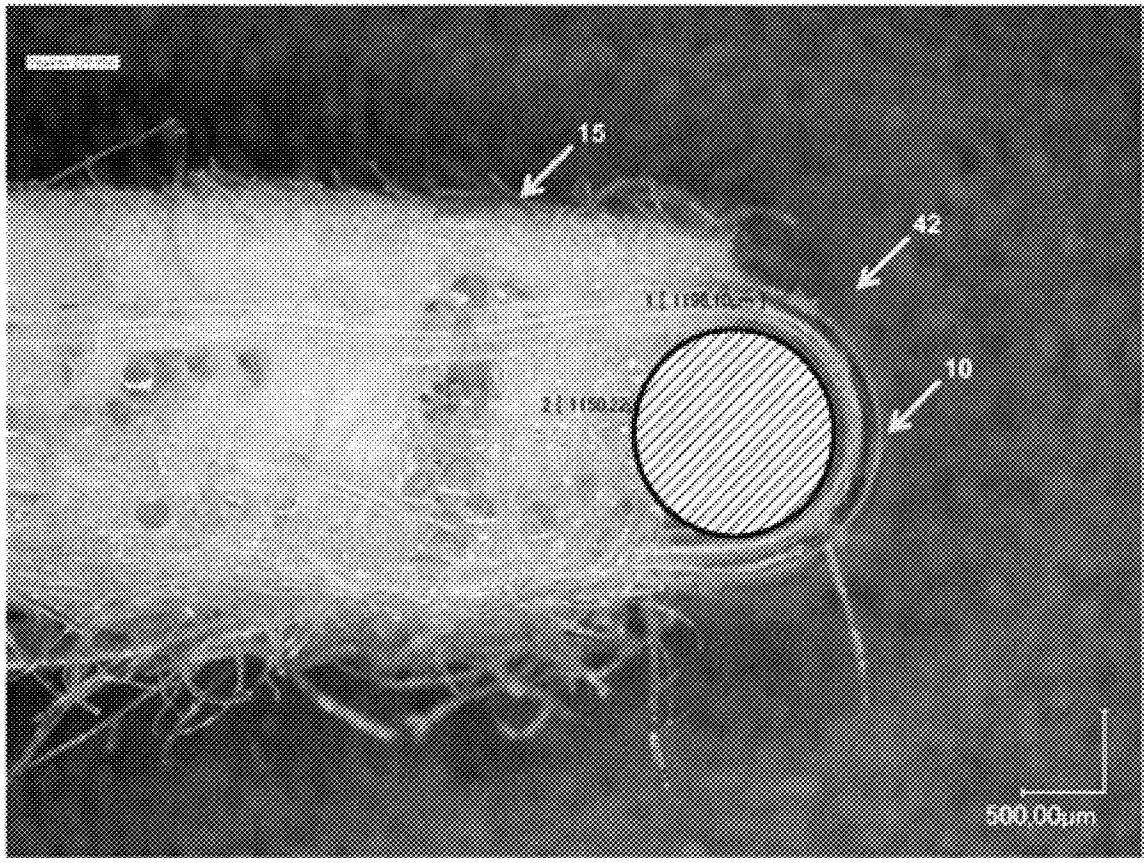

Figur 5
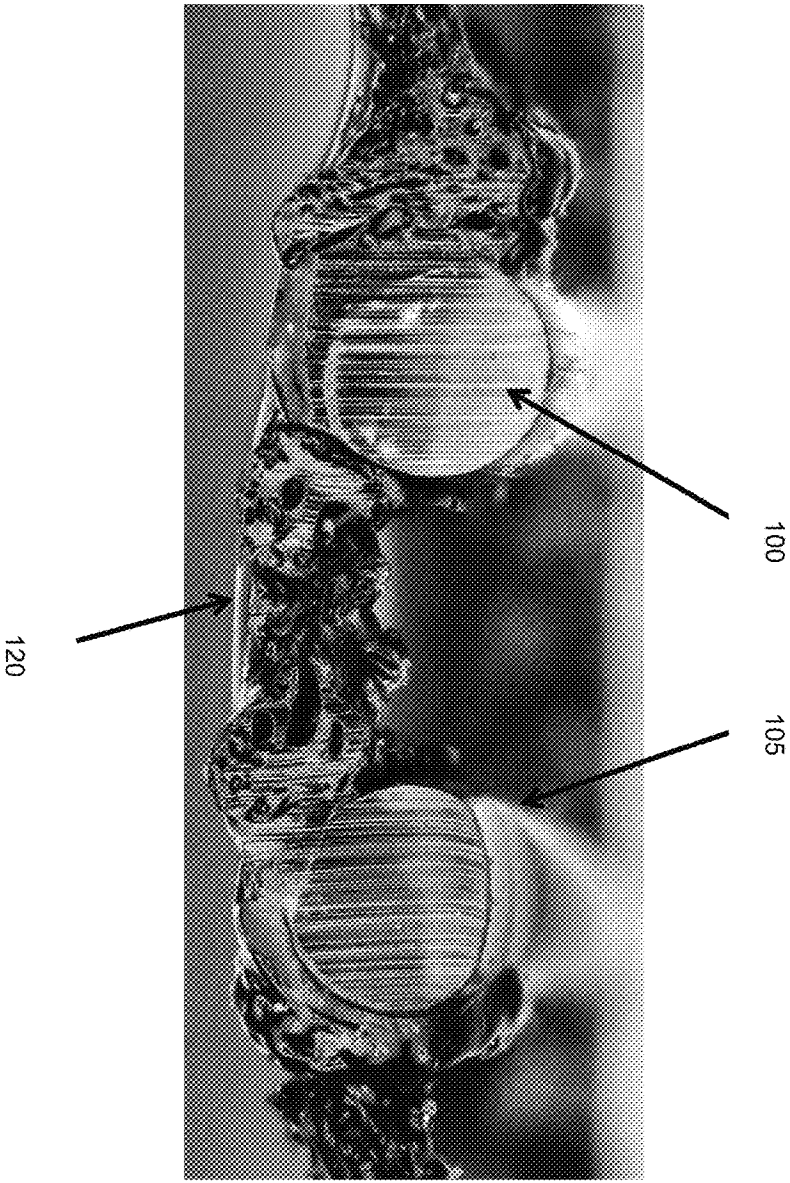

CLOTHING FOR A MACHINE FOR PRODUCING A FIBROUS MATERIAL WEB

BACKGROUND OF THE INVENTION

Field of the Invention

The invention relates to a clothing, in particular a seam felt, for a machine for producing a fibrous material web in particular a paper, board, tissue or pulp web, comprising a base structure which includes or is formed of a two-layer laminate structure formed from one or more flat-woven fabrics, the laminate structure has MD threads which form seam loops at the two end sides of the base structure, the two layers of the laminate structure are connected to each other by the seam loops, the clothing is made endless by connecting its end sides by a seam, and the seam is made by interengaging the seam loops of the two end sides and the insertion of an insertion element.

Clothings which are used in paper machines usually consist of endless belt loops. These belt loops are guided continuously in circulation over a multiplicity of supporting and guiding elements during operation of the machine and, in the process, are always under tension. In addition, they are subjected to loadings by presses, suction elements and the like.

In order to be able to withstand these loadings permanently, such clothings frequently have a woven base structure.

Various possible ways are known for producing a woven base structure in the endless configuration needed for the clothing. Most frequently, such structures are woven in the round. A tubular woven structure is produced directly on the loom. During use in a paper machine, this tube is rotated, so that the weft threads of the loom become the machine direction threads (MD threads) of the clothing.

However, this type of weaving is very time-consuming. In addition, the necessary length of the clothing must already be known exactly during weaving. Weaving "for stock" is not possible.

To enable a more efficient type of production, EP 0 425 523 proposes the use of flat-woven webs. These are provided in twice the length of the necessary clothing. By folding the long-side ends over and placing them on each other, a two-layer laminate structure is produced. By removing the CD threads at the folds, seam loops are produced. By interengaging the seam loops of both end sides and inserting an insertion element, this base structure can be made endless. As opposed to the structures woven in the round, here the warp threads of the fabric are the MD threads of the clothing. In this way, seam clothings can be produced very efficiently. In particular, a flat fabric can even be produced for stock and stored as a roll if the dimensions of the finished clothing are still not known. To finish the clothing, only the necessary length has to be unwound from the roll and, if appropriate, shortened in width to the clothing width.

However, this type of production also involves disadvantages.

Firstly, these lie in the region of the seam. At the seam point, the properties differ from those of the remaining parts of the clothing. For example, the permeability for water and air is frequently higher here than in the rest of the clothing. As a result, it is possible for quality losses to occur as a result of markings in the paper.

A further critical point is the "join". As result of the folding, the two long-side ends come to lie on one side of the base structure. They can be arranged to butt, overlap or to be at a distance. Also at this point, the properties of the base structure differ from the remaining regions, as a result of which markings in the paper can arise.

SUMMARY OF THE INVENTION

It is the object of the present invention, therefore, to specify a clothing which can be produced and used quickly and economically and, at the same time, overcomes the quality deficiencies known from the prior art.

This object is completely achieved by a clothing in which the diameter (LD) of the seam loops and the diameter (MDYD) of the associated MD threads has a ratio LD/MDYD between 2.5 and 4, in particular between 2.7 and 3.6.

For a better understanding of the invention, some explanations and definitions which are used within the context of this application should be presented first.

MD threads should be understood as threads which are oriented in the longitudinal direction of the base structure and the clothing or deviate therefrom by at most 10° (MD—machine direction).

CD threads should be understood as threads which are oriented in the transverse direction of the base structure and the clothing or deviate therefrom by at most 10° (CD—cross direction).

Within the context of this application, the term "diameter of a thread" is used. In the case of round threads, this term is well-defined.

For monofilaments which deviate from the round shape, or else for threads twisted from multiple monofilaments, the diameter of the thread should be understood to be the diameter of that circle which has the same area as the cross section of the thread or as the sum of the cross sections of the individual monofilaments.

For a monofilament having a square cross section and 1 mm edge length, the following diameter D would thus result:

$$A = 1[\mathrm{mm}^2] = \pi r^2 \Rightarrow r - \sqrt{\frac{1}{\pi}}\ [\mathrm{mm}] \Rightarrow D = 2r \approx 1.12[\mathrm{mm}]$$

To determine the diameter of a seam loop, the largest circle which can be inserted completely into the seam loop is ascertained. The diameter of this circle is then viewed as the diameter of the seam loop.

A clothing is proposed, in particular a seam felt for a machine for producing a fibrous material web, in particular paper, board, tissue or pulp web. The clothing comprises a base structure which comprises or consists of a two-layer laminate structure formed from one or more flat-woven elements.

The laminate structure has MD threads which form seam loops at the two end sides of the base structure and the two layers of the laminate structure are connected to each other via the. The clothing is made endless by connecting its end sides by means of a seam. This seam is formed by interengaging the seam loops of the two end sides and the insertion of an insertion element.

According to the invention, provision is made for the diameter of the seam loops (LD-loop diameter) and the diameter of the associated MD threads (MDYD—MD yarn diameter) to have a ratio LD/MDYD between 2.5 and 4, in particular between 2.7 and 3.6.

Trials by the applicant have shown that, given the LD/MDYD ratios according to the invention, the seam produced is optimal from several points of view.

Firstly, it has a very high strength, without which a satisfactory use, for example as a seam felt, is not possible.

In addition, the closure of the seam is very simply possible. The seam of a seam clothing is normally closed in the paper machine itself by drawing in an insertion element, also called a pintle. This drawing-in is done by hand and can be a lengthy process, particularly in wide machines. The fact that the loop diameter does not become too small in relation to the MD thread diameter means that it is made easier to draw in the pintle. In addition to this ergonomic advantage, the time to draw in a new clothing is shortened, which offers economic advantages for the operator of the installation.

However, the diameter or the LD/MDYD ratio must also not become too large. Excessively large loops can firstly lead to mechanical markings in the paper in that the bends of the loops are impressed into the paper, for example when passing through a press nip. On the other hand, large loops would also mean that the seam area itself becomes comparatively large. Since this seam area differs structurally from the remainder of the clothing and, in particular, also has a changed permeability for water and/or air, there is the danger in the seam area of hydraulic marking of the paper because of different dewatering. For this reason, it is desirable to keep the seam area as small as possible.

The LD/MDYD range according to the invention of between 2.5 and 4, in particular between 2.7 and 3.6, has proven to be the optimum compromise here.

In particular, the applicant has recognized the fact that it is not the absolute loop diameter (in mm) but the relative value LD/MDYD that has to be used as the characteristic variable.

Advantageous embodiments of the invention are described in the independent claims.

Provision can be made for the base structure to comprise still further components besides the two-layer laminate structure. For example, a further woven layer and/or a laid layer and/or a nonwoven layer can also be provided. The additional components can be arranged on the outside of the two-layer laminate structure. Alternatively or additionally, an additional component can also be arranged between the two layers of the two-layer laminate structure.

The two layers of the two-layer laminate structure can also be formed from a single flat-woven element. This flat fabric has—at least approximately—twice the length of the subsequent clothing. By means of folding and laying the two ends of the flat fabric on the central part of the flat cloth, a double-layer structure is produced, the seam loops being formed at the fold points. The long-side ends of the flat-woven element can be arranged to butt, overlap or be at a distance in a "join" area. The overlap or the distance is advantageously less than 5 cm, in particular less than 2 cm.

Alternatively, the two layers can also be formed from multiple flat-woven elements. All these flat-woven elements can have the same length. However, provision can also be made for these flat-woven elements to have different lengths. In these embodiments, too, the seam loops are formed by turning over one or two flat-woven elements. In this way, the two layers of the laminate structure are also connected to each other here by the seam loops.

If the base structure comprises multiple flat-woven elements, then multiple join areas are also produced, of which the same is true as described above for the case of one join area.

When multiple flat-woven elements are used, there is the possibility that all the elements consist of the same cloth. Alternatively, however, provision can also be made for the elements to differ in one or more features. The features can be the weaving pattern, the material, the diameter or the structure of the MD and/or CD threads or other characteristics of the fabric which are known to those skilled in the art.

One or all of the flat-woven elements can, for example, be implemented as a "plain weave", that is to say by means of a linen weave. This type of fabric is produced very simply and quickly, which is economically advantageous.

However, one known effect in two-layer woven structures is the moiré effect. This occurs more intensely in two-layer linen weaves. To reduce this effect, and thus also to reduce the danger of markings in the paper which are triggered by this effect, it may be advantageous if at least one or all of the flat-woven elements is/are not a linen weave.

In particular, it may be advantageous for this purpose if one or all of the flat-woven elements have floats which extend over two or more threads. Thus, the intensity of the moiré effect can be reduced. Nevertheless, the advantage of simple production of the seam loops is maintained.

All insertion elements known from the prior art can be used as the insertion element. In particular, pintles made of one or more filaments can be used.

The two layers of the two-layer laminate structure can advantageously be connected to each other by sewing or other suitable techniques. Preferably, such connections can be provided in the vicinity of the seam loops and/or in the vicinity of the join areas.

In preferred embodiments, provision can be made for each of the flat-woven elements to have a first and a second long-side end, and for the two-layer laminate structure to have at least one joint, at which two long-side ends are connected to each other. In this embodiment, at least one of the join areas is therefore designed as a joint. As described above, the joined long-side ends can belong to the same flat-woven element or to different flat-woven elements.

The connection at the joint or joints can be made by a multiplicity of known methods. In particular, the connection at the at least one joint can be made by an adhesively bonded connection and/or a welded connection. For instance, welded joints are possible by means of ultrasound or by means of a laser. Welding by means of an NIR laser in the transmission welding method is particularly advantageous. Laser transmission welding is advantageous in particular since the usual polyamide yarns of the fabric are transparent to laser light in a wide frequency range, and can be welded very simply by using absorbent, for example black, connecting threads. It is also possible to implement the joint in the form of a woven seam. Such woven seams are used, for example, to make woven forming clothings endless. Although woven seams are frequently more complicated to produce than bonded or welded connections, such a joint can have a very high strength.

Connecting the long-side ends by means of a joint offers a series of advantages. Firstly, the tensile strength of the two-layer laminate structure is increased thereby. The joint also serves to fix the loose ends of the MD threads at the long-side ends better. Without any such fixing, in some applications it is possible for these ends to loosen during the operation of the clothing and to be transported through nonwoven layers, etc., which may be present to the surface of the clothing. There, these loose ends can lead to damage and markings in the fibrous material web produced. As a result of fixing the loose ends by means of the joint, it is wholly or largely possible to avoid these ends working their way out.

Provision can preferably be made for the extent of the at least one joint in the machine direction (MD) to be less than 15 mm, less than 10 mm, in particular less than 5 mm. Since, at the joins or joints, there is once more the danger of different dewatering ratios as compared with the remainder of the clothing, a low extent of these areas is advantageous to reduce the tendency to marking.

While, until now, attempts were made in the prior art to make the join or joint area as similar as possible to the remainder of the clothing in important properties such as thickness and permeability, this embodiment of the invention follows a different path. Here, it is accepted that the properties of the base structure and of the clothing can differ from the remainder of the clothing in the joint area. Instead, the aim is to keep this different area as small as possible in the MD direction. In particular, in the case of felts, in which the applied nonwoven layers act as a type of diffuser, the different dewatering in this very small area can no longer be perceived in the paper as a marking.

It may be advantageous to assist this effect if the at least one joint, in particular all the joints, are made by connecting elements, in particular connecting threads, which are welded to at least one, preferably both, long-side end/s.

In particular, connecting threads which are arranged in the CD direction of the clothing can be used as connecting elements, at most three connecting threads, in particular at most two connecting threads, being provided for a joint.

If, for example, a connecting thread is placed transversely over the MD threads of the two long-side ends to be joined and is welded thereto, the result is a very firm joint connection, even with one or two such threads. Thus, the extent of the joint in the MD direction is extremely small, and the effect, for example a different permeability in this area, can no longer be seen in the paper.

Alternatively or additionally, provision can also be made for one or more of the connecting threads to be woven with MD threads of at least one long-side end.

Very suitable for this purpose is, for example, laser transmission welding, since the usual polyamide yarns of the fabric are transparent to laser light in a wide frequency range—specifically between 800 nm and 1000 nm—and can be welded very simply by using absorbent, for example black, connecting threads. The transparent joint partners in this joining method are heated substantially only at the surface. The structure of this transparent joint partner is largely maintained. This is advantageous, for example, if the transparent joint partner is an MD thread, which is subject to the tensile loading in the finished clothing. This is not substantially weakened by the laser transmission welding. Such a joint also has an adequate strength to withstand processing steps in the further course of production, in particular needling. As opposed to this, joints welded by means of ultrasound are frequently very brittle and fragile and are at least partly destroyed by the needling. As a result of the destruction of the joint, individual thread ends or thread components can also become detached again and project out of the clothing, which means that markings can be produced or the fibrous material web can be damaged.

Instead of threads, other types of connecting elements can also be used, such as woven or nonwoven tapes, strips of polymer material or the like. According to that stated above, it is generally advantageous if connecting elements only a low extent in the MD direction, in particular less than 5 mm, less than 2 mm or still better less than 1 mm.

In advantageous embodiments, provision can be made for the MD threads which are used in particular to form the seam loops to be embodied as monofilaments, in particular as monofilaments with a round cross section.

It may also be advantageous if the diameter of the MD threads is between 0.15 mm and 0.7 mm, in particular between 0.3 mm and 0.5 mm.

Besides the LD/MDYD ratio, it may also be advantageous for the properties of the seam area to match the "loop density" in the seam.

When determining the seam loop density, firstly the number of seam loops per unit length is ascertained. In a fabric having an MD thread density of 64 yarns/100 mm, the seam area has twice the number, i.e. 128 yarns/100 mm, as a result of the MD threads of the two ends interengaging. If the number of threads is multiplied by the diameter, then the seam loop density (statement in percent) is obtained as a measure of the coverage of the seam area by MD threads. If, in the above example, monofilaments having a diameter of 0.5 mm are used, then the result is a seam loop density of $$\frac{128/0.5[\text{mm}]}{100[\text{mm}]} = 64\%$$

It should be noted at this point that the seam loop density of a clothing can change during the production process. For example, thermal method steps can lead to shrinkage of the clothing in the transverse direction. Therefore, the seam loop density before the first thermal method step is normally lower, usually between 55% and 80%, while in the finished clothing it is then higher. The values of the seam loop density indicated in this application relate to the finished clothing, if not otherwise specified.

In a preferred embodiment, provision can be made for the loop density of the seam to be between 64% and 90%, in particular between 72% and 86%, specifically between 78% and 82%. Values of 80%, 81%, 82%, 83%, 84% and 85% have also proven to be particularly advantageous.

Since the permeability of the seam tends to be higher than in the remainder of the clothing, the permeability of the seam can be reduced by a comparatively high seam loop density. Increasing the loop density above 90% can, however, lead to the ability to seam the clothing simply, mentioned at the beginning, being to some extent lost, since it becomes more difficult to arrange for the seam loops to interengage. In a way similar to that in the LD/MDYD ratio, the range of the seam loop density listed here is, in a certain sense, an optimum range with two opposing requirements.

In this connection, reference should be made once more to the advantages if the base structure is constructed from flat-woven clothing. In classic base structures woven in the round, the fabric is rotated by 90° for use in the clothing. The warp threads of the loom become the CD threads of the clothing, and the weft threads become the MD threads. When flat-woven clothings are used, this is not so in most cases. Here, the fabric is not rotated, so that the MD threads of the base structure correspond to the warp threads of the loom. This has consequences for the respective thread density. During weaving, the weft threads are introduced substantially straight, while the warp threads each alternate from above the weft thread to below the weft thread. This leads, for example in the linen weave, to the crossing warp threads each running between two adjacent weft threads. For this reason, adjacent weft threads cannot be located as close to one another as desired. In the warp threads, there is no such restriction, since no crossing warp threads run between them. Therefore, adjacent warp threads can in principle be arranged as close to one another as desired.

Since, as described above, in flat-woven clothings the weft threads correspond to the MD threads of the clothing, when flat-woven clothings are used a higher MD thread density, and therefore also a higher loop density, can be achieved.

The loop densities of more than 64%, in particular more than 72% or 78%, described in this application can either not be achieved at all in clothings woven in the round or can be achieved by means of extreme weaving conditions such as a highly increased warp tension, which leads to highly accelerated wear of the loom.

By means of this embodiment of the invention, it is therefore possible to implement a clothing with a seam which—as a result of the high loop density—has a low permeability and nevertheless—as a result of the optimal LD/MDYD ratio, can be closed easily. On the other hand, other known methods for reducing the seam permeability, such as the insertion of a flow-impeding element ("scrim") into the seam area, lead to more difficult closure of the seam.

In advantageous embodiments, the seam area of the clothing—following the closure of the seam by means of the insertion element—can have a permeability which corresponds to between 80% and 130%, in particular between 90% and 120%, of the permeability of the clothing in an area remote from the seam.

In a preferred embodiment, the clothing has one or more layers of nonwoven fibers, at least on its upper side contacting the paper. In particular, the clothing can be a press felt. In addition, the clothing can be provided with one or more layers of nonwoven fibers on the underside contacting the rolls.

Advantageously, provision is made for some of the nonwoven fibers to have a fiber fineness of 67 dtex or more. In particular, these comparatively coarse fibers can be arranged in the direct vicinity of the base structure. Frequently, they are applied as a coarse nonwoven layer and needled with the base structure.

It is also possible for nonwoven fibers having a fineness of 44 dtex and less to be used. In particular, these comparatively fine fibers can be arranged on the paper-contacting upper side of the clothing. These fine fibers can be arranged on a nonwoven layer having the aforementioned coarse fibers with 67 dtex or more and needled therewith.

In this way, a good connection of the nonwoven layer to the base structure and of the individual nonwoven layers to one another can be achieved.

In particularly advantageous embodiments of the invention, at least some of the nonwoven fibers can comprise or consist of an elastomer, in particular a polyurethane. By using elastomers in the nonwoven fibers, the clothing can expand better again after passing through the press nip. As a result, the dewatering property of the clothing remains at a high level for longer, which offers economic advantages for the operator. In particular, in the area of the seam and the join region or regions, nonwoven fibers made of elastomer are advantageous. Here, their use is also advantageous since the elastic action further reduces the marking tendency of these points.

Finally, in advantageous embodiments of the clothing, provision can also be made for at least one strip-like, flow-impeding element to be provided in the area of the seam, which is configured such that the permeability for air and/or water in the area of the seam is substantially the same as in the rest of the clothing.

This flow-impeding element can be implemented in various ways. For example, it can be formed as a band of woven or nonwoven material. Alternatively, it can be a membrane, a film or a polymer foam. The element can also be implemented in the form of a cured liquid resin. Here, those skilled in the art will readily arrive at further suitable implementation forms.

The invention will be described in more detail below by using schematic sketches, not to scale.

BRIEF DESCRIPTION OF THE SEVERAL VIEWS OF THE DRAWING

FIGS. 1*a* to 1*c* show, schematically, the structure and the production of a base structure having a two-layer laminate structure for use in a clothing according to various embodiments of the invention.

FIGS. 2*a* to 2*c* show, schematically, the structure and the production of a base structure having a two-layer laminate structure for use in a clothing according to further embodiments of the invention.

FIG. 3 shows a clothing according to one aspect of the invention.

FIG. 4 shows a seam loop of a clothing according to one aspect of the invention.

FIG. 5 shows a possible embodiment of a joint.

DETAILED DESCRIPTION OF THE INVENTION

FIG. 1*a* shows a single flat-woven element 2 having a first long-side end 21 and a second long-side end 22, in plan view. The points 31 and 32 are the chosen folding points 31, 32, from which the seam loops 41, 42 are formed. FIG. 1*b* shows the flat-woven element 2 once more in a side view.

At the folding points 31, 32, one or more CD threads can be removed in each case.

As shown in FIG. 1*c*, to produce the base structure the flat-woven element 2 is folded at folding points 31, 32, and the folded parts are again laid on the flat-woven element 2. A two-layer laminate structure 1 is thus produced. The long-side ends 21, 22 can overlap, touch or, as shown in FIG. 1*c*, have a small distance from each other in the region of the join 20. In various embodiments of the invention, the join 20 can be embodied as a joint 200 at which two long-side ends 21, 22 are connected to each other. An advantageous joining method is welding, in particular ultrasonic and laser transmission welding. To improve stability, in particular during the processing, the two layers of the two-layer laminate structure 1 can be connected to each other, in particular sewn, at fixing points 110.

FIG. 2*a* shows a two-layer laminate structure 1 which comprises two flat-woven elements 2, 2*a*. The seam loops 41, 42 are formed here by the MD threads 10 of the first flat-woven element 2. The second flat-woven element 2*a* is arranged in such a way that its first long-side end 21*a* forms a join area with the second long-side end 22 of the first flat-woven element 2, while its second long-side end 22*a* forms a join area with the first long-side end 21 of the first flat-woven element 2. These join areas 20 can once more be embodied as joints 200.

To improve stability, in particular during the processing, the second flat-woven element 2*a* can be connected to the first flat-woven element 2, in particular sewn, at fixing points 110.

FIG. 2*b* shows a further embodiment of a two-layer laminate structure 1 which comprises two flat-woven elements 2, 2*a*. It differs from the structure illustrated in FIG. 2*a* in that a seam loop 41 is formed by MD threads 10 of the first flat-woven element 2, while the second seam loop 42 is formed by MD threads 10 of the second flat-woven element 2*a*. The two flat-woven elements 2, 2*a* can be the same, in particular also equally long. Alternatively, however, provision can also be made for them to differ in one or more features, in particular in length.

FIG. 2*c* shows a further embodiment of a two-layer laminate structure 1, which comprises three flat-woven elements 2, 2*a*, 2*b*.

FIG. 3 shows an embodiment of a clothing according to one aspect of the invention. Here, nonwoven layers 5*a*, 5*b*, 5*c*, 5*d*, are applied to the two-layer laminate structure 1 from FIG. 1*c*. These are usually fixed by needling. Otherwise, a further connection of the two layers of the two-layer laminate structure 1 to each other is carried out by the needling.

FIG. 4 shows a seam loop 42, formed from an MD thread 10. The MD thread 10 is embodied as a round monofilament here. A nonwoven layer 15 is provided on the upper side of the clothing. To determine the LD/MDYD ratio, a circle is inscribed in the seam loop 42. This is the largest circle which can be inserted completely into the seam loop 42. The determination of such circles and their diameters is a familiar geometric practice. In commercially available microscopes, such a measurement is also contained within the functional scope of the operating software. In the clothings according to this invention, the seam loops are also vertical or largely vertical, so that the problem of possible distortion does not occur. After interengaging the seam loops of the two ends, an insertion element or pintle shown with a hatched cross section in a circle is inserted in the loop opening so that the two loop ends can no longer disengage.

The diameter of the circle in the case of FIG. 4 is 1200 μm. The diameter of the MD thread is around 340 μm. The resultant LD/MDYD ratio is therefore 1200/340=3.5. A clothing having such seam loops thus fulfills the feature in which the diameter LD of the seam loops 41, 42 and the diameter MDYD of the associated MD threads 10 has a ratio LD/MDYD between 2.5 and 4, in particular between 2.7 and 3.6.

In FIG. 5, a detail of a joint 200 which is produced by means of laser transmission welding is illustrated by way of example. The transparent joining partners 100, 105 are connected to each other here by means of a connecting element 120. In FIG. 5, the connecting element 120 is embodied by way of example as a black thread 120. The transparent joining partners 100, 105 can be, for example, MD threads 10 of long-side ends 21, 22 of one or two flat-woven elements 2, 2*a*, 2*b*. It can be seen that although the connecting element 102 has been deformed noticeably by the welding operation, the transparent joining partners 100, 105 are largely structurally undamaged. Because of this property, connections produced by means of laser transmission welding can also be distinguished from other welded connections.

The invention claimed is:

1. A clothing or a seam felt for a machine for producing a fibrous material, paper, board, tissue or pulp web, comprising:

a base structure including a two-layer laminate structure formed of one or a plurality of flat-woven fabrics, said base structure having two end sides;

said laminate structure having MD threads being monofilaments with a round cross section forming seam loops at said two end sides of said base structure, said seam loops interconnecting said two layers of said laminate structure, said seam loops having a diameter LD and said associated MD threads having a diameter MDYD;

a seam interconnecting said end sides to make the clothing endless, said seam being formed by interengaging said seam loops of said two end sides and an insertion of an insertion element;

said seam having a loop density of between 64% and 90%; and said diameter LD of said seam loops and said diameter MDYD of said associated MD threads having a ratio LD/MDYD of between 2.7 and 3.6.

2. The clothing according to claim 1, wherein at least one of said flat-woven fabrics have floats extending over two or a plurality of threads.

3. The clothing according to claim 1, wherein each of said flat-woven fabrics has a first and a second long-side end, said two-layer laminate structure has at least one joint at which two of said long-side ends are interconnected, and said interconnected long-side ends belong to an identical flat-woven fabric or to different flat-woven fabrics.

4. The clothing according to claim 3, wherein said two long-side ends are interconnected by a welded connection or a laser transmission welded connection.

5. The clothing according to claim 3, wherein said at least one joint has an extent in a machine direction of less than 15 mm.

6. The clothing according to claim 5, wherein said extent of said at least one joint in the machine direction is less than 5 mm.

7. The clothing according to claim 3, wherein said at least one joint is made by connecting elements or connecting threads being welded to at least one or both of said long-side ends.

8. The clothing according to claim 7, wherein said connecting elements are connecting threads disposed in a CD direction of the clothing, and at most three connecting threads or at most two connecting threads are provided for a joint.

9. The clothing according to claim 8, wherein one or a plurality of said connecting threads are woven with MD threads of at least one of said long-side ends.

10. The clothing according to claim 1, wherein said diameter of said MD threads is between 0.15 mm and 0.7 mm.

11. The clothing according to claim 10, wherein said diameter of said MD threads is between 0.3 mm and 0.5 mm.

12. The clothing according to claim 1, wherein said loop density of said seam is between 72% and 86%.

13. The clothing according to claim 1, which further comprises one or a plurality of layers of nonwoven fibers disposed at least on an upper side of the clothing for contacting the web.

14. The clothing according to claim 13, wherein at least some of said nonwoven fibers include or are formed of an elastomer or a polyurethane.

15. The clothing according to claim 1, which further comprises at least one strip-shaped flow-impeding element provided in a vicinity of said seam, said at least one strip-shaped flow-impeding element being configured to cause a permeability for at least one of air or water in said vicinity of said seam to be substantially identical to a remainder of the clothing.

* * * * *